US010865636B2

(12) United States Patent
Wilson et al.

(10) Patent No.: US 10,865,636 B2
(45) **Date of Patent: *Dec. 15, 2020**

(54) FIBER OPTIC MEASUREMENTS TO EVALUATE FLUID FLOW

(71) Applicant: SCHLUMBERGER TECHNOLOGY CORPORATION, Sugar Land, TX (US)

(72) Inventors: Colin Allan Wilson, Sugar Land, TX (US); Joel Herve Le Calvez, Houston, TX (US); Brian D. Clark, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/340,825

(22) PCT Filed: Oct. 10, 2017

(86) PCT No.: PCT/US2017/055827

§ 371 (c)(1),
(2) Date: Apr. 10, 2019

(87) PCT Pub. No.: WO2018/071357

PCT Pub. Date: Apr. 19, 2018

(65) Prior Publication Data

US 2019/0264556 A1 Aug. 29, 2019

Related U.S. Application Data

(60) Provisional application No. 62/406,021, filed on Oct. 10, 2016.

(51) Int. Cl.
*E21B 47/103* (2012.01)
*E21B 43/26* (2006.01)
(Continued)

(52) U.S. Cl.
CPC ..... *E21B 47/103* (2020.05); *E21B 43/26* (2013.01); *E21B 47/04* (2013.01); *E21B 47/06* (2013.01); *E21B 47/07* (2020.05)

(58) Field of Classification Search
CPC ..... E21B 43/26; E21B 47/06; E21B 47/065; E21B 47/1005; E21B 47/04
See application file for complete search history.

(56) References Cited

U.S. PATENT DOCUMENTS 4,705,113 A * 11/1987 Perkins ..... E21B 43/26 166/302
5,442,173 A * 8/1995 Wraight ..... E21B 43/26 250/260

(Continued)

FOREIGN PATENT DOCUMENTS

WO 2013070345 A1 5/2013

OTHER PUBLICATIONS

Le Calvez et al., "Tool and velocity model calibration for downhole-based hydraulic fracture monitoring of induced microseismicity", Society of Exploration Geophysicists Annual Conference and Exhibition, 2013, pp. 2193-2195.

*Primary Examiner* — James G Sayre
(74) *Attorney, Agent, or Firm* — Rodney Wartford

(57) ABSTRACT

A method includes varying a temperature of a treatment fluid. The treatment fluid is pumped into the first wellbore as part of a fluid diversion process or a fluid treatment process after the temperature of the treatment fluid is varied. A first downhole measurement is obtained in the first wellbore using a cable in the first wellbore or a first sensor coupled to the cable concurrently with or after the fluid diversion process or the fluid treatment process. An additional measurement is obtained concurrently with obtaining the first downhole measurement. The first downhole measurement and the additional measurement are combined or compared.

(Continued)

A location where the treatment fluid is flowing through perforations in the first wellbore is determined based upon the combining or comparing the first downhole measurement and the additional measurement.

20 Claims, 7 Drawing Sheets

(51) Int. Cl.

| | |
|---|---|
| ***E21B 47/04*** | (2012.01) |
| ***E21B 47/06*** | (2012.01) |
| ***E21B 47/07*** | (2012.01) |

(56) References Cited

U.S. PATENT DOCUMENTS

| | | | | |
|---|---|---|---|---|
| 2008/0000635 | A1 | 1/2008 | Rioufol et al. | |
| 2010/0000508 | A1* | 1/2010 | Chandler | F24H 1/06 126/116 R |
| 2010/0207019 | A1* | 8/2010 | Hartog | E21B 47/101 250/269.1 |
| 2013/0324444 | A1 | 12/2013 | Lesko et al. | |
| 2015/0128692 | A1 | 5/2015 | Chen et al. | |
| 2020/0032640 | A1* | 1/2020 | Wilson | E21B 47/06 |

* cited by examiner

FIBER OPTIC MEASUREMENTS TO EVALUATE FLUID FLOW

CROSS-REFERENCE TO RELATED APPLICATIONS

This application claims priority to U.S. Provisional Patent Application No. 62/406,021 filed on Oct. 10, 2016, the entirety of which is incorporated herein by reference.

BACKGROUND

Hydraulic fracturing technology uses recorded microseismic and seismic events for determining the extent of, and mapping, fractures induced by reservoir stimulation methods. This procedure is commonly referred to as hydraulic fracture monitoring ("HFM"). In HFM, fluid is pumped into a series of perforations at varying depths in the wellbore. In order to control the fluid through a particular set of perforations, a plug is placed at a specific depth so that the fluid pumped into the wellbore cannot reach the perforations below the plug location. The fluid creates fractures in the wellbore above the plug. This operation uses several trips in the wellbore to place the plug and to make the perforations. The plugs are then drilled out once the fracture treatment is completed. At this point, the location of the fluid is assumed based on the location of the plug, but the efficiency of the fluid flow through the perforations is not known, and the effectiveness of the perforation flow is estimated using the surface fluid pressure.

A more efficient well treatment process includes perforating the wellbore in one trip and then pumping a diverter to block off selected perforation zones in order to treat the desired stages. The fluid diverter and treatment fluid effectiveness may be monitored at the perforation zones to modify and assess the treatment fluid composition to maximize perforation treatment flow. Currently, the effectiveness of the diverter is determined by monitoring the surface pressure. As the surface pressure increases, it shows diversion is taking place somewhere in the wellbore. However, the location of the diversion is unknown.

SUMMARY

A method for inducing temperature changes in an injected treatment fluid to evaluate fluid flow in a wellbore is disclosed. The method includes varying a temperature of a treatment fluid. The treatment fluid is pumped into a first wellbore as part of a fluid diversion process or a fluid treatment process after the temperature of the treatment fluid is varied. A first downhole measurement is obtained in the first wellbore using a cable in the first wellbore or a first sensor coupled to the cable concurrently with or after the fluid diversion process or the fluid treatment process. An additional measurement is obtained concurrently with obtaining the first downhole measurement. The first downhole measurement and the additional measurement are combined or compared. A location where the treatment fluid is flowing through perforations in the first wellbore is determined based upon the combining or comparing the first downhole measurement and the additional measurement.

In another embodiment, the method includes running a first downhole tool into a first wellbore. The first wellbore is perforated using the first downhole tool. A fiber-optic cable is run into the first wellbore after the first wellbore is perforated. A temperature of a treatment fluid is varied. The treatment fluid is pumped into the first wellbore as part of a fluid diversion process or a fluid treatment process after the first wellbore is perforated and after the temperature of the treatment fluid is varied. A first downhole measurement is obtained in the first wellbore using the fiber-optic cable concurrently with or after the fluid diversion process or the fluid treatment process. The first downhole measurement is a temperature measurement at a plurality of locations along the fiber-optic cable. An additional measurement is obtained concurrently with obtaining the first downhole measurement. The additional measurement is (1) a pressure measurement or a flow rate measurement obtained at a surface location or (2) a pressure wave measurement or a shear wave measurement obtained in a second wellbore. The first downhole measurement and the additional measurement are combined or compared. A location where the treatment fluid is flowing through the perforations in the first wellbore is determined based upon the combining or comparing the first downhole measurement and the additional measurement. A parameter of the treatment fluid being pumped into the first wellbore is varied in response to determining the location where the treatment fluid is flowing. The parameter includes a pressure, a flow rate, a composition, or a combination thereof.

A system for inducing temperature changes in an injected treatment fluid to evaluate fluid flow in a wellbore is disclosed. The system includes a first downhole tool that is run into a first wellbore and perforates the first wellbore. The system also includes a cable that is run into the first wellbore and obtains a first downhole measurement concurrently with or after a fluid diversion process or a fluid treatment process in the first wellbore. The fluid diversion process or the fluid treatment process takes place after the first wellbore is perforated, and the fluid diversion process or the fluid treatment process includes pumping a treatment fluid into the first wellbore after a temperature of the treatment fluid is varied. The system also includes a first sensor that obtains an additional measurement concurrently with the cable obtaining the first downhole measurement. The system also includes a processor that combines or compares the first downhole measurement and the additional measurement and determines a location where the treatment fluid is flowing through the perforations based upon the combining or comparing the first downhole measurement and the additional measurement.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The accompanying drawings, which are incorporated in and constitute a part of this specification, illustrate embodiments of the present teachings and together with the description, serve to explain the principles of the present teachings.

DETAILED DESCRIPTION

Reference will now be made in detail to embodiments, examples of which are illustrated in the accompanying drawings and figures. In the following detailed description, numerous specific details are set forth in order to provide a thorough understanding of the invention. However, it will be apparent to one of ordinary skill in the art that the invention may be practiced without these specific details. In other instances, well-known methods, procedures, components, circuits and networks have not been described in detail so as not to obscure aspects of the embodiments.

It will also be understood that, although the terms first, second, etc. may be used herein to describe various elements, these elements should not be limited by these terms. These terms are used to distinguish one element from another. For example, a first object could be termed a second object, and, similarly, a second object could be termed a first object, without departing from the scope of the invention. The first object and the second object are both objects, respectively, but they are not to be considered the same object.

The terminology used in the description of the invention herein is for the purpose of describing particular embodiments and is not intended to be limiting of the invention. As used in the description of the invention and the appended claims, the singular forms "a," "an" and "the" are intended to include the plural forms as well, unless the context clearly indicates otherwise. It will also be understood that the term "and/or" as used herein refers to and encompasses any possible combinations of one or more of the associated listed items. It will be further understood that the terms "includes," "including," "comprises" and/or "comprising," when used in this specification, specify the presence of stated features, integers, operations, elements, and/or components, but do not preclude the presence or addition of one or more other features, integers, operations, elements, components, and/or groups thereof. Further, as used herein, the term "if" may be construed to mean "when" or "upon" or "in response to determining" or "in response to detecting," depending on the context.

Attention is now directed to processing procedures, methods, techniques and workflows that are in accordance with some embodiments. Some operations in the processing procedures, methods, techniques and workflows disclosed herein may be combined and/or the order of some operations may be changed.

Figure 1A:
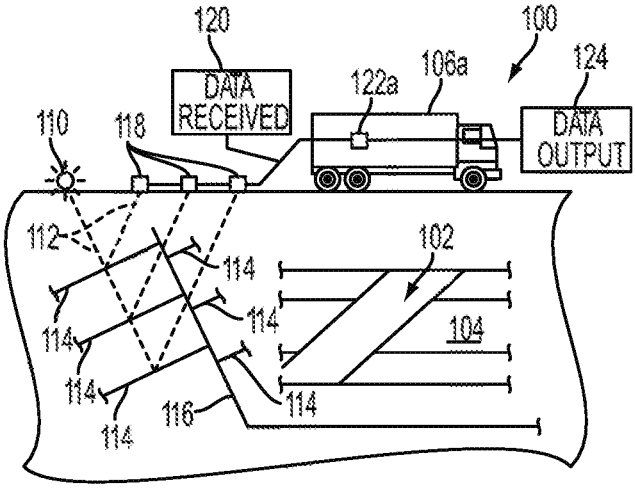
FIGS. 1A, 1B, 1C, 1D, 2, 3A, and 3B illustrate simplified, schematic views of an oilfield and its operation, according to an embodiment.

FIGS. 1A-1D illustrate simplified, schematic views of oilfield 100 having subterranean formation 102 containing reservoir 104 therein in accordance with implementations of various technologies and techniques described herein. FIG. 1A illustrates a survey operation being performed by a survey tool, such as seismic truck 106*a*, to measure properties of the subterranean formation. The survey operation is a seismic survey operation for producing sound vibrations. In FIG. 1A, one such sound vibration, e.g., sound vibration 112 generated by source 110, reflects off horizons 114 in earth formation 116. A set of sound vibrations is received by sensors, such as geophone-receivers 118, situated on the earth's surface. The data received 120 is provided as input data to a computer 122*a* of a seismic truck 106*a*, and responsive to the input data, computer 122*a* generates seismic data output 124. This seismic data output may be stored, transmitted or further processed as desired, for example, by data reduction.

Figure 1B:
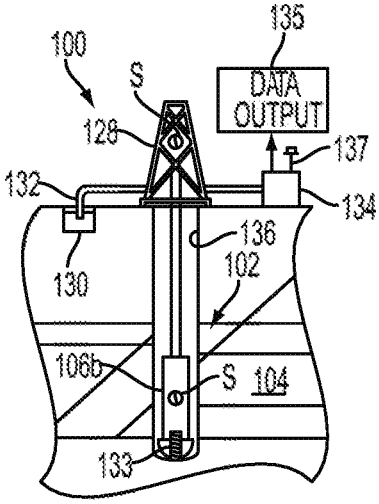

FIG. 1B illustrates a drilling operation being performed by drilling tools 106.2 suspended by rig 128 and advanced into subterranean formations 102 to form wellbore 136. Mud pit 130 is used to draw drilling mud into the drilling tools via flow line 132 for circulating drilling mud down through the drilling tools, then up wellbore 136 and back to the surface. The drilling mud can be filtered and returned to the mud pit. A circulating system may be used for storing, controlling, or filtering the flowing drilling mud. The drilling tools are advanced into subterranean formations 102 to reach reservoir 104. Each well may target one or more reservoirs. The drilling tools are adapted for measuring downhole properties using logging while drilling tools. The logging while drilling tools may also be adapted for taking core sample 133 as shown.

Computer facilities may be positioned at various locations about the oilfield 100 (e.g., the surface unit 134) and/or at remote locations. Surface unit 134 may be used to communicate with the drilling tools and/or offsite operations, as well as with other surface or downhole sensors. Surface unit 134 is capable of communicating with the drilling tools to send commands to the drilling tools, and to receive data therefrom. Surface unit 134 may also collect data generated during the drilling operation and produce data output 135, which may then be stored or transmitted.

Sensors (S), such as gauges, may be positioned about oilfield 100 to collect data relating to various oilfield operations as described previously. As shown, sensor (S) is positioned in one or more locations in the drilling tools and/or at rig 128 to measure drilling parameters, such as weight on bit, torque on bit, pressures, temperatures, flow rates, compositions, rotary speed, and/or other parameters of the field operation. Sensors (S) may also be positioned in one or more locations in the circulating system.

Drilling tools 106*b* may include a bottom hole assembly (BHA) (not shown), generally referenced, near the drill bit (e.g., within several drill collar lengths from the drill bit). The bottom hole assembly includes capabilities for measuring, processing, and storing information, as well as communicating with surface unit 134. The bottom hole assembly further includes drill collars for performing various other measurement functions.

The bottom hole assembly may include a communication subassembly that communicates with surface unit 134. The communication subassembly is adapted to send signals to and receive signals from the surface using a communications channel such as mud pulse telemetry, electro-magnetic telemetry, or wired drill pipe communications. The communication subassembly may include, for example, a transmitter that generates a signal, such as an acoustic or electromagnetic signal, which is representative of the measured drilling parameters. It will be appreciated by one of skill in the art that a variety of telemetry systems may be employed, such as wired drill pipe, electromagnetic or other known telemetry systems.

The wellbore can be drilled according to a drilling plan that is established prior to drilling. The drilling plan can set forth equipment, pressures, trajectories and/or other parameters that define the drilling process for the wellsite. The drilling operation may then be performed according to the drilling plan. However, as information is gathered, the drilling operation may deviate from the drilling plan. Additionally, as drilling or other operations are performed, the subsurface conditions may change. The earth model may also be adjusted as new information is collected The data gathered by sensors (S) may be collected by surface unit 134 and/or other data collection sources for analysis or other processing. The data collected by sensors (S) may be used alone or in combination with other data. The data may be collected in one or more databases and/or transmitted on or offsite. The data may be historical data, real time data, or combinations thereof. The real time data may be used in real time, or stored for later use. The data may also be combined with historical data or other inputs for further analysis. The data may be stored in separate databases, or combined into a single database.

Surface unit 134 may include transceiver 137 to allow communications between surface unit 134 and various portions of the oilfield 100 or other locations. Surface unit 134 may also be provided with or functionally connected to one or more controllers (not shown) for actuating mechanisms at oilfield 100. Surface unit 134 may then send command signals to oilfield 100 in response to data received. Surface unit 134 may receive commands via transceiver 137 or may itself execute commands to the controller. A processor may be provided to analyze the data (locally or remotely), make the decisions and/or actuate the controller. In this manner, oilfield 100 may be selectively adjusted based on the data collected. This technique may be used to modify portions of the field operation, such as controlling drilling, weight on bit, pump rates, or other parameters. These adjustments may be made automatically based on computer protocol, and/or manually by an operator. In some cases, well plans may be adjusted to select modified operating conditions, or to avoid problems.

Figure 1C:
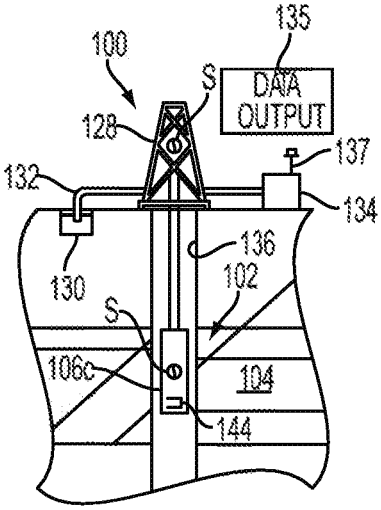

FIG. 1C illustrates a wireline operation being performed by wireline tool 106*c* suspended by rig 128 and into wellbore 136 of FIG. 1B. Wireline tool 106*c* is adapted for deployment into wellbore 136 for generating well logs, performing downhole tests and/or collecting samples. Wireline tool 106*c* may be used to provide another method and apparatus for performing a seismic survey operation. Wireline tool 106*c* may, for example, have an explosive, radioactive, electrical, or acoustic energy source 144 that sends and/or receives electrical signals to surrounding subterranean formations 102 and fluids therein.

Wireline tool 106*c* may be operatively connected to, for example, geophones 118 and a computer 122*a* of a seismic truck 106*a* of FIG. 1A. Wireline tool 106*c* may also provide data to surface unit 134. Surface unit 134 may collect data generated during the wireline operation and may produce data output 135 that may be stored or transmitted. Wireline tool 106*c* may be positioned at various depths in the wellbore 136 to provide a survey or other information relating to the subterranean formation 102.

Sensors (S), such as gauges, may be positioned about oilfield 100 to collect data relating to various field operations as described previously. As shown, sensor S is positioned in wireline tool 106*c* to measure downhole parameters which relate to, for example porosity, permeability, fluid composition and/or other parameters of the field operation.

Figure 1D:
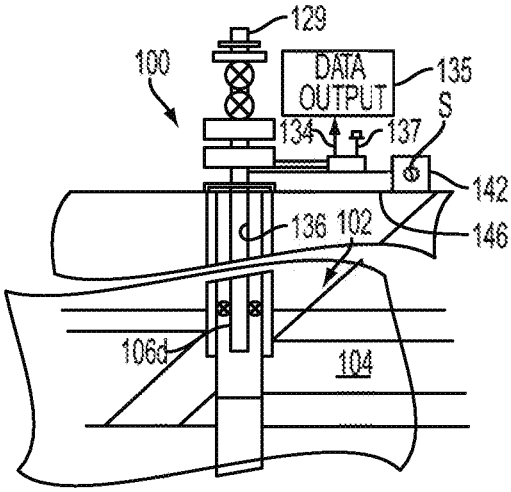

FIG. 1D illustrates a production operation being performed by production tool 106*d* deployed from a production unit or Christmas tree 129 and into completed wellbore 136 for drawing fluid from the downhole reservoirs into surface facilities 142. The fluid flows from reservoir 104 through perforations in the casing (not shown) and into production tool 106*d* in wellbore 136 and to surface facilities 142 via gathering network 146.

Sensors (S), such as gauges, may be positioned about oilfield 100 to collect data relating to various field operations as described previously. As shown, the sensor (S) may be positioned in production tool 106*d* or associated equipment, such as Christmas tree 129, gathering network 146, surface facility 142, and/or the production facility, to measure fluid parameters, such as fluid composition, flow rates, pressures, temperatures, and/or other parameters of the production operation.

Production may also include injection wells for added recovery. One or more gathering facilities may be operatively connected to one or more of the wellsites for selectively collecting downhole fluids from the wellsite(s).

While FIGS. 1B-1D illustrate tools used to measure properties of an oilfield, it will be appreciated that the tools may be used in connection with non-oilfield operations, such as gas fields, mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The field configurations of FIGS. 1A-1D are intended to provide a brief description of an example of a field usable with oilfield application frameworks. Part or the entirety, of oilfield 100 may be on land, water, and/or sea. Also, while a single field measured at a single location is depicted, oilfield applications may be utilized with any combination of one or more oilfields, one or more processing facilities and one or more wellsites.

Figure 2:
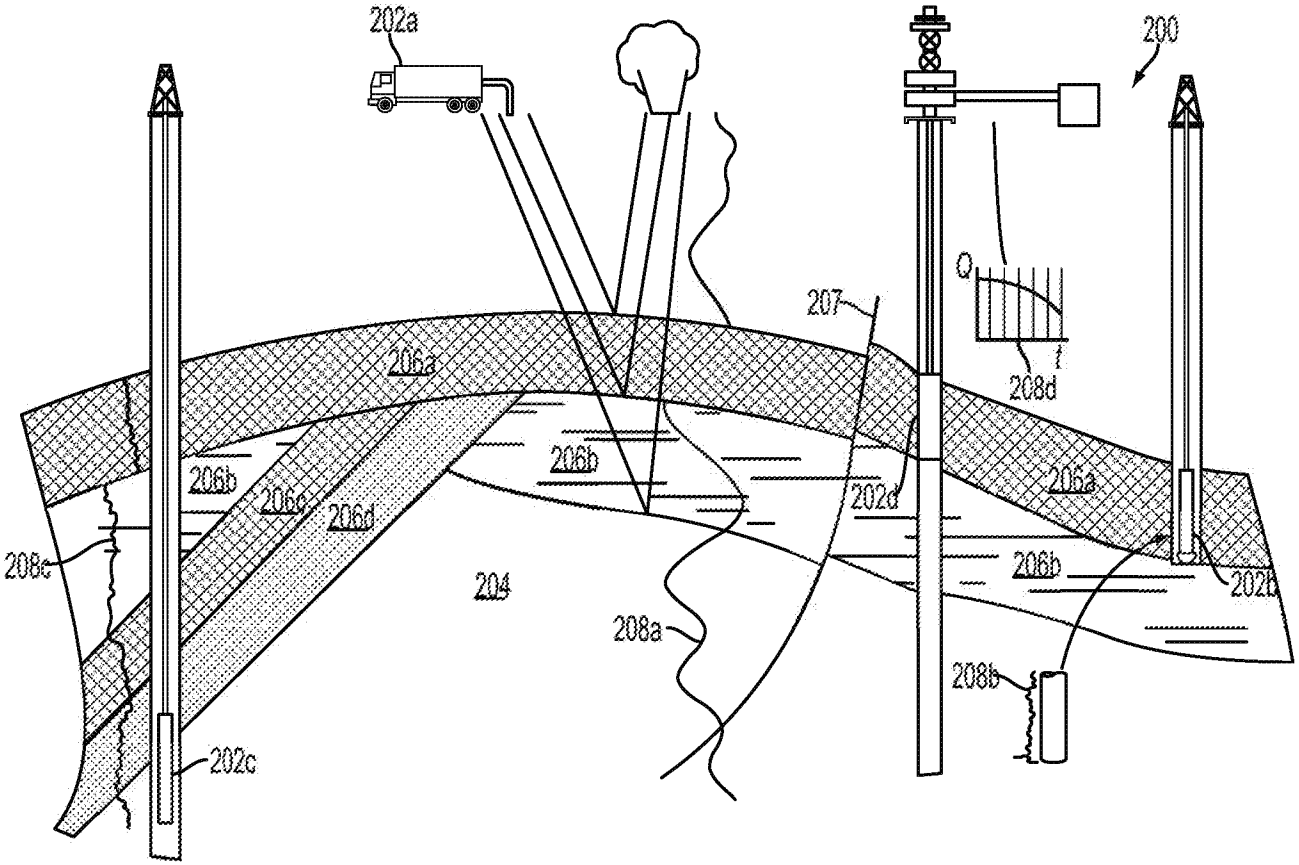

FIG. 2 illustrates a schematic view, partially in cross section of oilfield 200 having data acquisition tools 202*a*, 202*b*, 202*c* and 202*d* positioned at various locations along oilfield 200 for collecting data of subterranean formation 204 in accordance with implementations of various technologies and techniques described herein. Data acquisition tools 202*a*-202*d* may be the same as data acquisition tools 106*a*-106*d* of FIGS. 1A-1D, respectively, or others not depicted. As shown, data acquisition tools 202*a*-202*d* generate data plots or measurements 208*a*-208*d*, respectively. These data plots are depicted along oilfield 200 to demonstrate the data generated by the various operations.

Data plots 208*a*-208*c* are examples of static data plots that may be generated by data acquisition tools 202*a*-202*c*, respectively; however, it should be understood that data plots 208*a*-208*c* may also be data plots that are updated in real time. These measurements may be analyzed to better define the properties of the formation(s) and/or determine the accuracy of the measurements and/or for checking for errors. The plots of each of the respective measurements may be aligned and scaled for comparison and verification of the properties.

Static data plot 208*a* is a seismic two-way response over a period of time. Static plot 208*b* is core sample data measured from a core sample of the formation 204. The core sample may be used to provide data, such as a graph of the density, porosity, permeability, or some other physical property of the core sample over the length of the core. Tests for density and viscosity may be performed on the fluids in the core at varying pressures and temperatures. Static data plot 208*c* is a logging trace that can provide a resistivity or other measurement of the formation at various depths.

A production decline curve or graph 208*d* is a dynamic data plot of the fluid flow rate over time. The production decline curve can provide the production rate as a function of time. As the fluid flows through the wellbore, measurements are taken of fluid properties, such as flow rates, pressures, composition, etc.

Other data may also be collected, such as historical data, user inputs, economic information, and/or other measurement data and other parameters of interest. As described below, the static and dynamic measurements may be analyzed and used to generate models of the subterranean formation to determine characteristics thereof. Similar measurements may also be used to measure changes in formation aspects over time.

The subterranean structure 204 has a plurality of geological formations 206*a*-206*d*. As shown, this structure has several formations or layers, including a shale layer 206*a*, a carbonate layer 206*b*, a shale layer 206*c* and a sand layer 206*d*. A fault 207 extends through the shale layer 206*a* and the carbonate layer 206*b*. The static data acquisition tools are adapted to take measurements and detect characteristics of the formations.

While a specific subterranean formation with specific geological structures is depicted, it will be appreciated that oilfield 200 may contain a variety of geological structures and/or formations, sometimes having extreme complexity. In some locations, such as below the water line, fluid may occupy pore spaces of the formations. Each of the measurement devices may be used to measure properties of the formations and/or its geological features. While each acquisition tool is shown as being in specific locations in oilfield 200, it will be appreciated that one or more types of measurement may be taken at one or more locations across one or more fields or other locations for comparison and/or analysis.

The data collected from various sources, such as the data acquisition tools of FIG. 2, may then be processed and/or evaluated. Seismic data displayed in static data plot 208*a* from data acquisition tool 202*a* can be used by a geophysicist to determine characteristics of the subterranean formations and features. The core data shown in static plot 208*b* and/or log data from well log 208*c* can be used by a geologist to determine various characteristics of the subterranean formation. The production data from graph 208*d* can be used by the reservoir engineer to determine fluid flow reservoir characteristics. The data analyzed by the geologist, geophysicist and the reservoir engineer may be analyzed using modeling techniques.

Figure 3A:
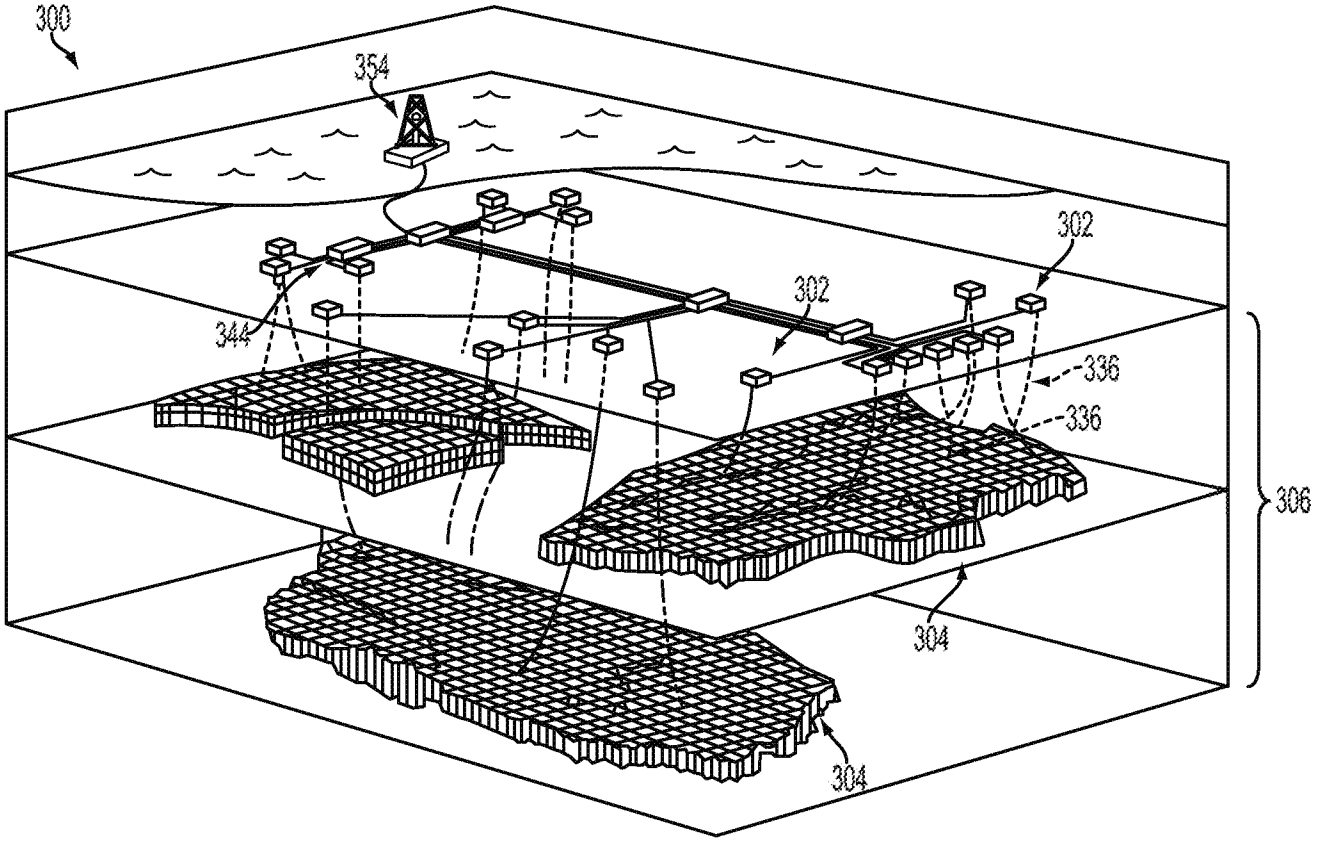

FIG. 3A illustrates an oilfield 300 for performing production operations in accordance with implementations of various technologies and techniques described herein. As shown, the oilfield has a plurality of wellsites 302 operatively connected to central processing facility 354. The oilfield configuration of FIG. 3A is not intended to limit the scope of the oilfield application system. The oilfield, or a part thereof, may be on land and/or sea. Also, while a single oilfield with a single processing facility and a plurality of wellsites is depicted, any combination of one or more oilfields, one or more processing facilities and one or more wellsites may be present.

Each wellsite 302 has equipment that forms wellbore 336 into the earth. The wellbores extend through subterranean formations 306 including reservoirs 304. These reservoirs 304 contain fluids, such as hydrocarbons. The wellsites draw fluid from the reservoirs and pass them to the processing facilities via surface networks 344. The surface networks 344 have tubing and control mechanisms for controlling the flow of fluids from the wellsite to processing facility 354.

Figure 3B:
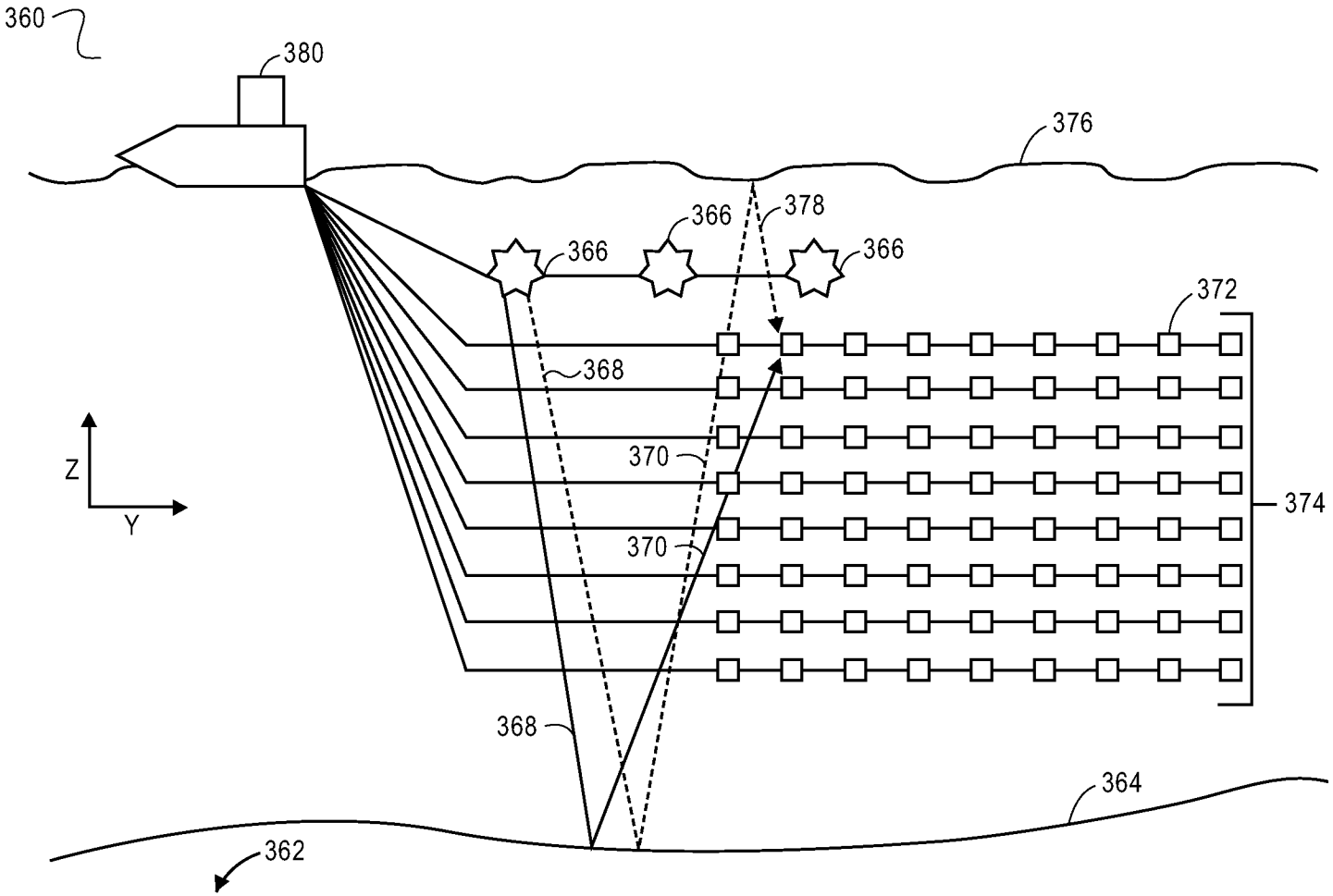

Attention is now directed to FIG. 3B, which illustrates a side view of a marine-based survey 360 of a subterranean subsurface 362 in accordance with one or more implementations of various techniques described herein. Subsurface 362 includes seafloor surface 364. Seismic sources 366 may include marine sources such as vibroseis or airguns, which may propagate seismic waves 368 (e.g., energy signals) into the Earth over an extended period of time or at a nearly instantaneous energy provided by impulsive sources. The seismic waves may be propagated by marine sources as a frequency sweep signal. For example, marine sources of the vibroseis type may initially emit a seismic wave at a low frequency (e.g., 5 Hz) and increase the seismic wave to a high frequency (e.g., 80-90 Hz) over time.

The component(s) of the seismic waves 368 may be reflected and converted by seafloor surface 364 (i.e., reflector), and seismic wave reflections 370 may be received by a plurality of seismic receivers 372. Seismic receivers 372 may be disposed on a plurality of streamers (i.e., streamer array 374). The seismic receivers 372 may generate electrical signals representative of the received seismic wave reflections 370. The electrical signals may be embedded with information regarding the subsurface 362 and captured as a record of seismic data.

In one implementation, each streamer may include streamer steering devices such as a bird, a deflector, a tail buoy and the like, which are not illustrated in this application. The streamer steering devices may be used to control the position of the streamers in accordance with the techniques described herein.

In one implementation, seismic wave reflections 370 may travel upward and reach the water/air interface at the water surface 376, a portion of reflections 370 may then reflect downward again (i.e., sea-surface ghost waves 378) and be received by the plurality of seismic receivers 372. The sea-surface ghost waves 378 may be referred to as surface multiples. The point on the water surface 376 at which the wave is reflected downward is generally referred to as the downward reflection point.

The electrical signals may be transmitted to a vessel 380 via transmission cables, wireless communication or the like. The vessel 380 may then transmit the electrical signals to a data processing center. In some embodiments, the vessel 380 may include an onboard computer capable of processing the electrical signals (i.e., seismic data). Those skilled in the art having the benefit of this disclosure will appreciate that this illustration is highly idealized. For instance, surveys may be of formations deep beneath the surface. The formations may include multiple reflectors, some of which may include dipping events, and may generate multiple reflections (including wave conversion) for receipt by the seismic receivers 372. In one implementation, the seismic data may be processed to generate a seismic image of the subsurface 362.

Marine seismic acquisition systems tow each streamer in streamer array 374 at the same depth (e.g., 5-10 m). However, marine based survey 360 may tow each streamer in streamer array 374 at different depths such that seismic data may be acquired and processed in a manner that avoids the effects of destructive interference due to sea-surface ghost waves. For instance, marine-based survey 360 of FIG. 3B illustrates eight streamers towed by vessel 380 at eight different depths. The depth of each streamer may be controlled and maintained using the birds disposed on each streamer.

Fluid diversion and location may be monitored in real-time by using a cable located in a wellbore during the diversion or treatment process. The cable may contain an embedded fiber or fibers for obtaining distributed measurements of temperature, pressure, vibration, strain, acoustic noises, pressure (P) waves, shear (S) waves, or a combination thereof. This data is monitored in real-time and may be combined with pressure measurements captured/obtained by a sensor at the surface to verify the effectiveness of the diversion and treatment fluids as well as the flow in the wellbore through perforations at different depths. By showing the volumetric fluid flow and flow locations in real-time, the diversion and treatment fluid composition and volume may be controlled in real-time to modify the perforation flow in the wellbore.

In one embodiment, the temperature of a treatment fluid being pumped into the wellbore may be varied. For example, the temperature of the treatment fluid may be reduced by adding solid carbon dioxide or liquid nitrogen into the treatment fluid prior to pumping the treatment fluid into the wellbore. In another example, the temperature of the treatment fluid may be increased by heating the treatment fluid in a boiler or adding a chemical that induces an exothermic reaction. The temperature of the treatment fluid may be monitored as it flows through perforations at different depths. Colder or hotter fluid temperatures may be seen in contrast to the temperatures of the other fluids in the wellbore (wellbore fluid). The distance that the cold or hot flow travels indicates the extent to which the treatment fluid travels in the wellbore before flowing into the perforations. Thus, the location of the perforations may be determined based upon a location where the temperature changes because the treatment fluid (e.g., a cold temperature slug) is displaced with warmer wellbore fluid at the location where the treatment fluid flows into the perforations. This allows the low temperature and vibration of the cold fluid slug to be clearly traced and measured by the distributed fiber optic cable. When solid carbon dioxide is added to the treatment fluid, it may produce cavitation noise as it boils in the warmer wellbore fluid, allowing it to be tracked acoustically in the wellbore. A similar tracing exercise may be done by pumping fluids which have different pipe friction characteristics which induce vibration in the wellbore differently.

Thus, in order to determine fluid flow location(s) and efficiency in a wellbore during or after perforation treatment, the treatment fluid may be cooled using solid carbon dioxide or liquid nitrogen producing a thermal marker in the treatment fluid that may be tracked using distributed fiber optics that measure temperature, vibration, pressure, and strain. Knowing, in real time, where the fluid is flowing in the wellbore may indicate the diversion and treatment effectiveness, and the treatment process may be adjusted to maximize the generation of hydraulic fracturing events.

Figure 4:
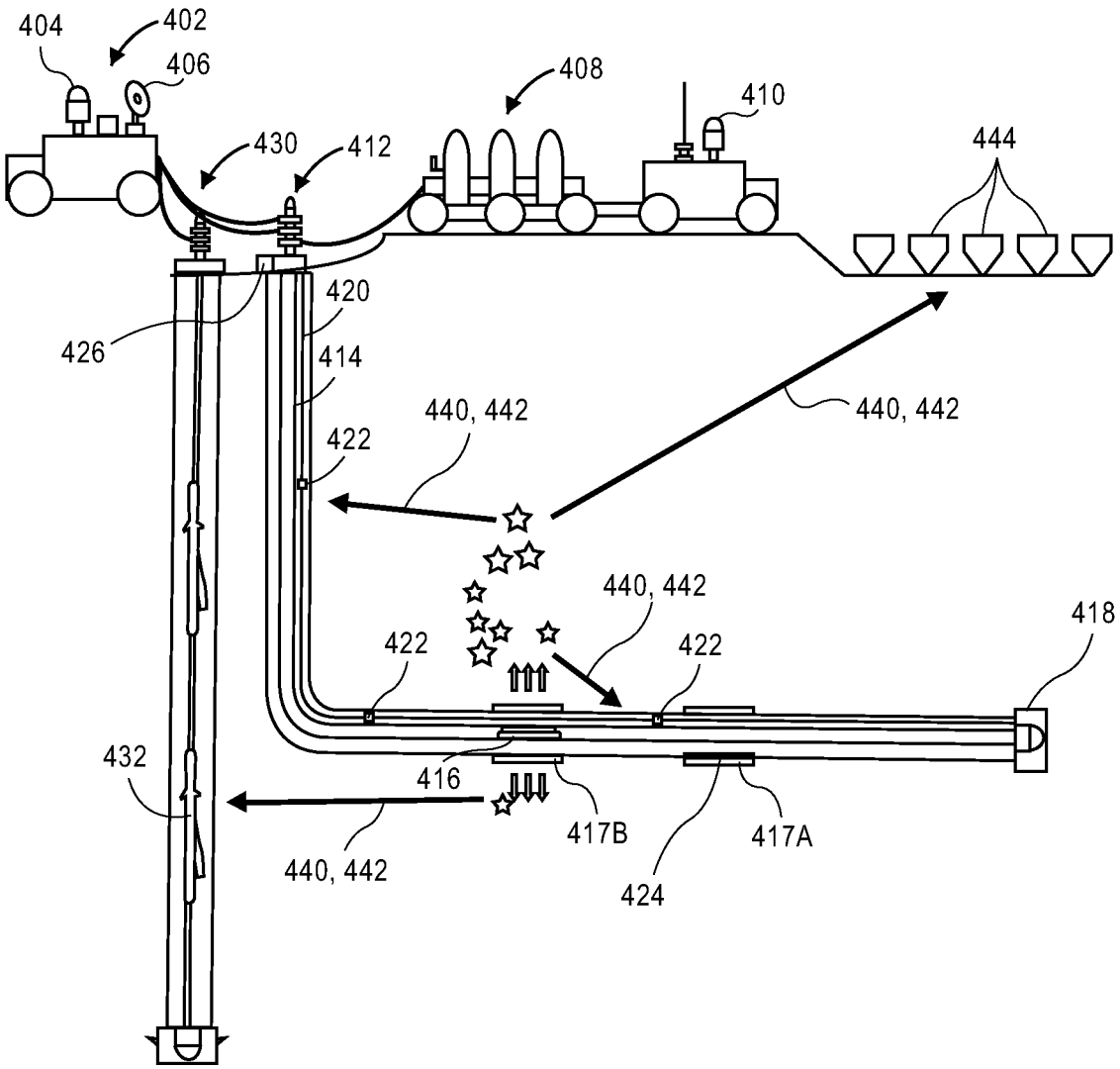
FIG. 4 illustrates a schematic side view of a wellsite, according to an embodiment.

FIG. 4 illustrates a schematic side view of a wellsite (e.g., a wellsite 302), according to an embodiment. The wellsite may include a recording unit 402 at the surface. As shown, the recording unit 402 may be a truck having a global positioning system ("GPS") 404 and/or a satellite system 406. The wellsite may also have a pump unit 408 at the surface. As shown, the pump unit 408 may be part of a frac van, which may also have a GPS 410. The pump unit 408 may be configured to pump fluid into a wellbore to fracture the surrounding subterranean formation.

A first (e.g., production) wellbore 412 may be provided and extend downward into the subterranean formation from the surface. As shown, the first wellbore 412 may have a substantially vertical portion and a substantially horizontal portion; however, in other embodiments, the first wellbore 412 may extend other directions. The first wellbore 412 may have one or more tubular members 414 positioned therein. The tubular members 414 may be or include casing segments, liner segments, drill pipe segments, or the like. For example, the tubular members 414 may be drill pipe segments that form a drill string. A first downhole tool 416 may be coupled to the drill string 414. The first downhole tool 416 may be or include a perforating device (e.g., a perforating gun) that creates perforations 417A, 417B in the first wellbore 412 and/or the tubular members 414. One or more plugs 418 may also be positioned within the first wellbore 412.

A cable (also referred to as a control line) 420 may also be positioned in the first wellbore 412. The cable 420 may be positioned within the tubular members 414 or in an annulus between the tubular members 414 and a wall of the first wellbore 412. The cable 420 may also be placed behind the casing (e.g., cement). The cable 420 may include one or more fiber-optic cables or "fibers," which may be configured to measure one or more distributed physical characteristics of the first wellbore 112 (e.g., temperature, pressure, vibration, strain, pressure (P) waves 440, shear (S) waves 442, or a combination thereof). In another embodiment, one or more sensors 422 may be coupled to the cable 420 and be configured to measure the one or more physical characteristics.

In at least one embodiment, a second (e.g., monitoring) wellbore 430 may be positioned proximate to the first wellbore 412 in the subterranean formation. The second wellbore 430 may extend deeper into the subterranean formation than the first wellbore 412. A second downhole tool 432 may be positioned within the second wellbore 430. The second downhole tool 432 may be or include one or more seismic sensors that are configured to sense P waves 440 and/or S waves 442. In at least some embodiments, the second wellbore 430 and/or the second downhole tool 432 may be omitted.

Figure 5:
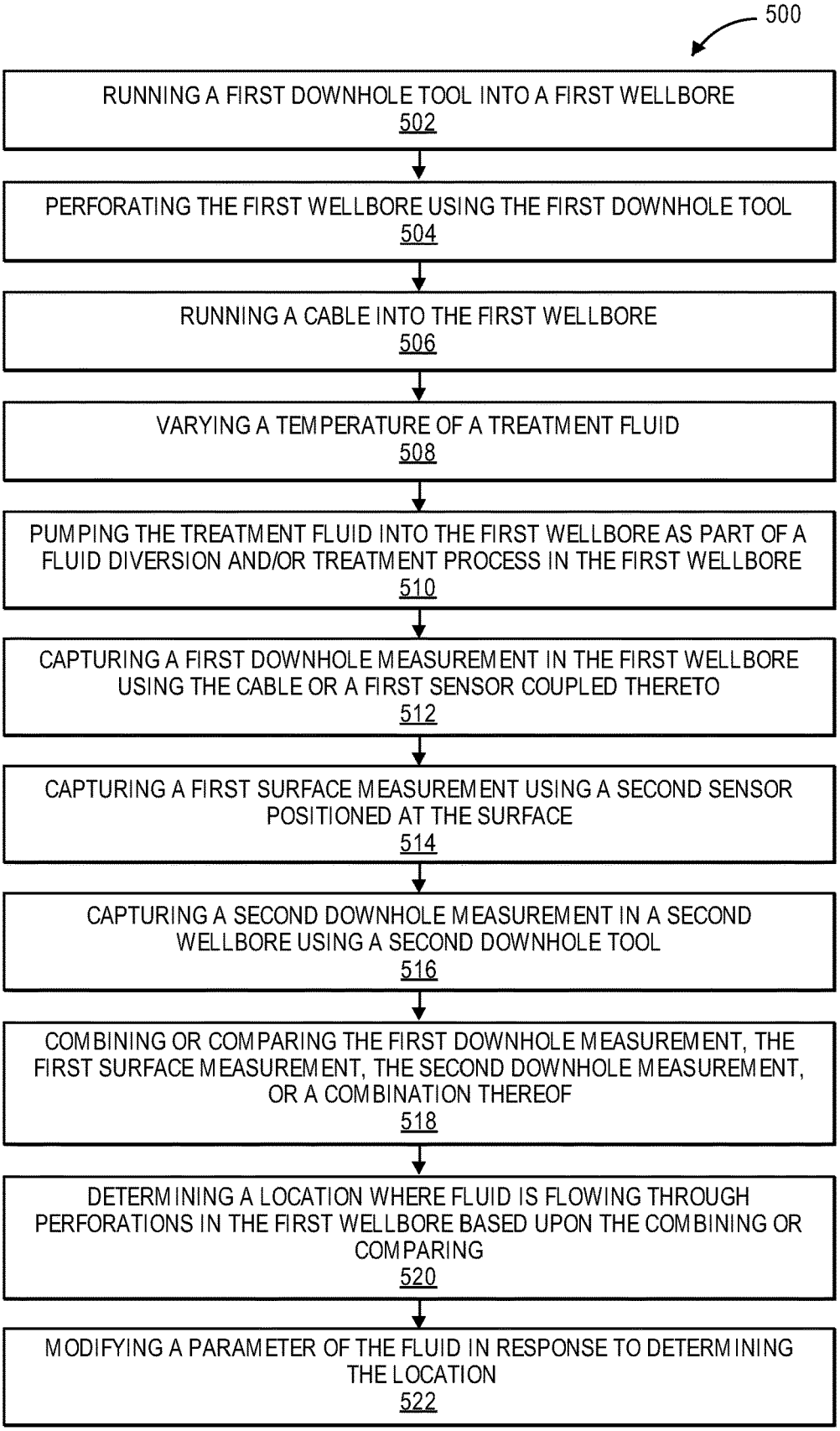
FIG. 5 illustrates a flowchart of a method for inducing temperature changes to an injected treatment fluid to evaluate fluid flow in a wellbore, according to an embodiment.

FIG. 5 illustrates a flowchart of a method 500 for inducing temperature changes in an injected treatment fluid to evaluate fluid flow in the wellbore 512, according to an embodiment. The method 500 may include running the first downhole tool 416 into the first wellbore 412, as at 502. The method 500 may also include perforating the first wellbore 412 using the first downhole tool 416, as at 504. The method 500 may also include running the cable 420 into the first wellbore 412, as at 506. The cable 420 may be run (e.g., lowered) into the first wellbore 412 before, simultaneously with, or after the first downhole tool 416. For example, the cable 420 may be run into the first wellbore 412 after the first wellbore 412 is perforated (e.g., at perforations 417A, 417B).

The method 500 may also include varying a temperature of a treatment fluid, as at 508. The treatment fluid may include, for example, water mixed with sand and/or chemicals (e.g., salts, acids, carbonates, etc.). The treatment fluid may be heated, for example, using a boiler or by adding chemicals that generate an exothermic reaction. In other embodiments, the treatment fluid may be cooled by adding solid carbon dioxide, liquid carbon dioxide, liquid nitrogen, water ice, or the like. In some instances, the treatment fluid may include a friction reducer or polymer to reduce the turbulent flow of the treatment fluid in the casing. However, in some embodiments, the friction reducer or polymer may not be added to the treatment fluid to create a higher friction pressure that may induce more vibration in the first wellbore 412.

The method 500 may also include pumping the treatment fluid into the first wellbore 412 as part of a fluid diversion and/or treatment process, as at 510. The fluid diversion and/or treatment process may be initiated/performed after the first downhole tool 416 is run into the first wellbore 412, after the first wellbore 412 is perforated, and/or after the cable 420 is run into the first wellbore 412. As used herein, "fluid diversion" refers to introducing a diverter 424 into the first wellbore 412 that prevents the treatment fluid from flowing through at least a portion of the perforations 417A, 417B. For example, the diverter 424 may prevent the treatment fluid from flowing through a first subset of the perforations 417A in the first wellbore 412 while allowing the treatment fluid to flow through a second subset of the perforations 417B in the first wellbore 412. The first subset of perforations 417A may be below (i.e., closer to the toe of the first wellbore 412) than the second set of perforations 417B. The diverter 424 may be or include a ball, a gel, a pill, a foam, fibers, particulates, or the like. As used herein, "treatment process" refers to pumping the treatment fluid and/or a liquid, a solid, a gas, a foam, or a combination thereof into the first wellbore 412 to modify the production characteristics of the reservoir in the subterranean formation. The treatment process may include hydraulic fracturing, matrix acidizing, chemical treatments designed to modify the flow characteristics, preventing or removing scale, removing waxes, removing paraffin, removing asphaltines, or a combination thereof to treat the first wellbore 412.

The method 500 may also include capturing/obtaining one or more first downhole measurements in the first wellbore 412 using the cable 420 and/or the sensor(s) 422 coupled to the cable 420, as at 512. The first downhole measurements may be captured concurrently with or after the fluid diversion and/or treatment process. The first downhole measurements may be or include temperature, pressure, flow rate, vibration, strain, acoustic noises, P waves 440, S waves 442, or a combination thereof in the first wellbore 412.

In one example, the temperature of the treatment fluid may be measured by the cable 420 and/or the sensor(s) 422 at a plurality of locations along the cable 420 as the treatment fluid flows through the first wellbore 412. When the treatment fluid reaches a set of perforations (e.g., 417B) through which the treatment fluid flows, the temperature measured by the cable 420 and/or the sensor(s) 422 downstream from this location may be that of the wellbore fluid, which has a different temperature than the treatment fluid. Thus, the locations of the perforations 417A, 417B through which the treatment fluid is flowing may then be determined based on the temperature measurements at various locations along the cable 420. In another example, solid carbon dioxide in the treatment fluid may start to boil and create gas, which creates a cavitation noise in the first wellbore 412. The cavitation noise may be captured/obtained by the cable 420 and/or the sensor(s) 422 as pressure or vibration measurements. In another example, the hot or cold temperatures of the treatment fluid may cause deformation of metallic objects (e.g., the casing) in the first wellbore 412. The deformation may be captured/obtained by the cable 420 and/or the sensor(s) 422 as strain measurements, vibration measurements, and/or pressure measurements. In another example, when a friction reducer or polymer is not added to the treatment fluid, the higher friction pressure may induce vibration in the first wellbore 412, which may be captured/obtained by the cable 420 and/or the sensor(s) 422. In another example, when the subterranean formation is fractured by the treatment fluid, P waves 440 may be generated. The P waves 440 may be captured/obtained by the cable 420 and/or the sensor(s) 422 at one or more locations along the cable 420. In yet another example, the cable 420 and/or the sensor(s) 422 may capture/obtain flow noise of the treatment fluid (or other fluids) flowing through the perforations 417A, 417B. Sensing the first downhole measurement(s) at more than one location along the control line 420 may enable the user to locate the location(s) where the treatment fluid is flowing (e.g., through the fractures and/or perforations 417A, 417B) in the first wellbore 412.

The method 500 may also include capturing/obtaining one or more additional (e.g., first surface) measurements using a second sensor 426 positioned at the surface, as at 514. The first surface measurements may be captured concurrently with or after the fluid diversion and/or treatment process. The first surface measurements may be captured concurrently with or after the capturing of the first downhole measurements. The first surface measurements may be or include pressure, flow rate, vibration, gravity change, or a combination thereof.

The method 500 may also include capturing/obtaining one or more additional (e.g., second downhole) measurements in the second wellbore 430 using the second downhole tool 432, as at 516. The second downhole measurements may be captured concurrently with or after the fluid diversion and/or treatment process. The second downhole measurements may be captured concurrently with or after the capturing of the first downhole measurements. The second downhole measurements may be or include the P waves 440 and/or the S waves 442 that are generated in response to the fracturing. The P waves 440 and/or the S waves 442 may also be captured using seismic sensors 444 positioned at the surface (i.e., second surface measurements).

The method 500 may also include combining and/or comparing the first downhole measurements, the second downhole measurements, the first surface measurements, the second surface measurements, or a combination thereof, as at 518. The method 500 may also include determining a location where the treatment fluid is flowing (e.g., through perforations 417A, 417B) in the first wellbore 412 based upon the combining and/or comparing the measurements, as at 520. More particularly, combining or comparing the measurements may enable the user to locate (e.g., triangulate) the location(s) where the treatment fluid is flowing (e.g., through the fractures and/or perforations 417A, 417B) in the first wellbore 412. The combining and/or comparing the measurements may be one of a parameter vs. neighboring time/space.

The method 500 may also include modifying a parameter of the treatment fluid being pumped into the first wellbore 112 in response to the combining/comparing or in response to determining the location where the treatment fluid is flowing, as at 522. The parameter may be or include the pressure, the volumetric flow rate, the composition, the viscosity, the concentration (e.g., of proppant), the type or quantity of diversion materials, the schedule (e.g., order/timing of fluid/particulates), or a combination thereof to modify production. In some embodiments, the parameter(s) may be adjusted incrementally, and portions of the method 500 may be repeated until one or more of the parameters are modified. Additionally, in further embodiments, portions of the method 500 may be repeated to incrementally adjust parameters for multiple perforation intervals in order to modify parameters for each interval.

In one or more embodiments, the functions described can be implemented in hardware, software, firmware, or any combination thereof. For a software implementation, the techniques described herein can be implemented with modules (e.g., procedures, functions, subprograms, programs, routines, subroutines, modules, software packages, classes, and so on) that perform the functions described herein. A module can be coupled to another module or a hardware circuit by passing and/or receiving information, data, arguments, parameters, or memory contents. Information, arguments, parameters, data, or the like can be passed, forwarded, or transmitted using any suitable means including memory sharing, message passing, token passing, network transmission, and the like. The software codes can be stored in memory units and executed by processors. The memory unit can be implemented within the processor or external to the processor, in which case it can be communicatively coupled to the processor via various means as is known in the art.

Figure 6:
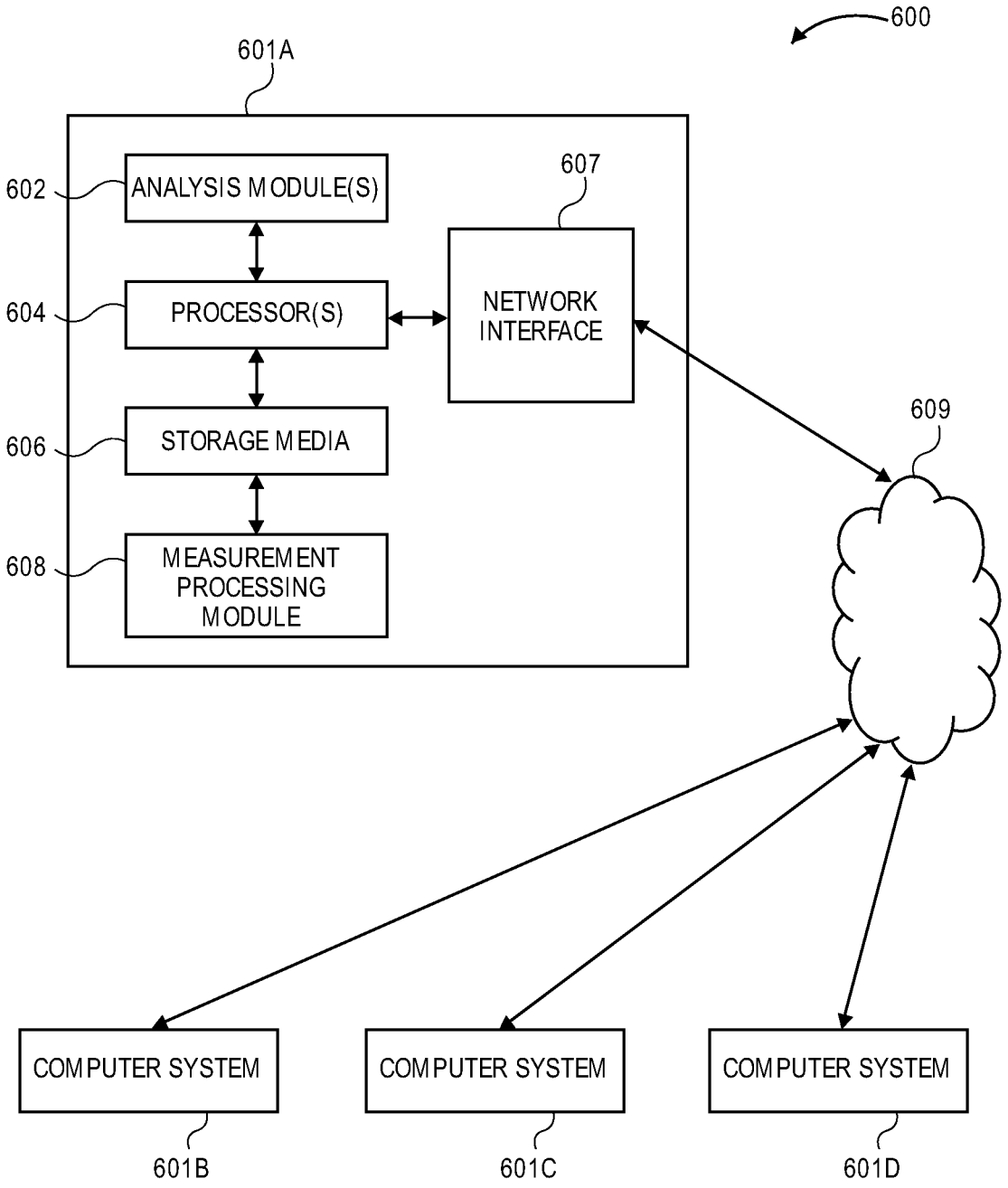
FIG. 6 depicts an illustrative computing system for performing at least a portion of the method, according to an embodiment.

In some embodiments, the methods of the present disclosure may be executed by a computing system. FIG. 6 illustrates an example of such a computing system 600, in accordance with some embodiments. The computing system 600 may include a computer or computer system 601A, which may be an individual computer system 601A or an arrangement of distributed computer systems. In various embodiments, the computer system 601A can implement the cloud computing environment. The computer system 601A includes one or more analysis modules 602 that are configured to perform various tasks according to some embodiments, such as one or more methods disclosed herein. To perform these various tasks, the analysis module 602 executes independently, or in coordination with, one or more processors 604, which is (or are) connected to one or more storage media 606. The processor(s) 604 is (or are) also connected to a network interface 607 to allow the computer system 601A to communicate over a data network 609 with one or more additional computer systems and/or computing systems, such as 601B, 601C, and/or 601D (note that computer systems 601B, 601C and/or 601D may or may not share the same architecture as computer system 601A, and may be located in different physical locations, e.g., computer systems 601A and 601B may be located in a processing facility, while in communication with one or more computer systems such as 601C and/or 601D that are located in one or more data centers, and/or located in varying countries on different continents). In various embodiments, computing systems 601B, 601C, and/or 601D can represent computing systems utilized by users of the cloud computing environment.

A processor may include a microprocessor, microcontroller, processor module or subsystem, programmable integrated circuit, programmable gate array, or another control or computing device.

The storage media 606 may be implemented as one or more computer-readable or machine-readable storage media. Note that while in the example embodiment of FIG. 6 storage media 606 is depicted as within computer system 601A, in some embodiments, storage media 606 may be distributed within and/or across multiple internal and/or external enclosures of computing system 601A and/or additional computing systems. Storage media 606 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that instructions may be provided on one computer-readable or machine-readable storage medium, or may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, computing system 600 contains one or more measurement processing module(s) 608. In the example of computing system 600, computer system 601A includes the measurement processing module 608. In some embodiments, a single measurement processing module may be used to perform some aspects of one or more embodiments of the method 500 disclosed herein. In another embodiment, a plurality of measurement processing modules may be used to perform some aspects of method 500 herein.

It should be appreciated that computing system 600 is one example of a computing system, and that computing system 600 may have more or fewer components than shown, may combine additional components not depicted in the example embodiment of FIG. 6, and/or computing system 600 may have a different configuration or arrangement of the components depicted in FIG. 6. The various components shown in FIG. 6 may be implemented in hardware, software, or a combination of both hardware and software, including one or more signal processing and/or application specific integrated circuits.

Further, processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included in various embodiments.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods are described herein is illustrative and the order may be re-arranged, and/or two or more elements may occur simultaneously. The embodiments were chosen and described in order to best explain the principals of the invention and its practical applications, to thereby enable others skilled in the art to utilize the described embodiments with various modifications as are suited to the particular use contemplated.

What is claimed is:

1. A method, comprising:

pumping a treatment fluid into a first wellbore as part of a fluid diversion process or a fluid treatment process, wherein a temperature of the treatment fluid causes deformation of an object in the first wellbore;

obtaining a first downhole measurement in the first wellbore using a cable in the first wellbore or a first sensor coupled to the cable concurrently with or after the fluid diversion process or the fluid treatment process, wherein the first downhole measurement comprises a strain measurement, a vibration measurement, or a pressure measurement at a plurality of locations in the first wellbore related to the deformation;

obtaining one or more additional measurements concurrently with obtaining the first downhole measurement;

combining or comparing the first downhole measurement and the one or more additional measurements; and determining a location where the treatment fluid is flowing through perforations in the first wellbore based upon the combining or comparing the first downhole measurement and the one or more additional measurements.

2. The method of claim 1, wherein the cable is positioned in a tubular in the first wellbore.

3. The method of claim 1, wherein the cable is positioned in an annulus between a tubular in the first wellbore and a wall of the first wellbore.

4. The method of claim 1, wherein the cable is positioned outside a casing in the first wellbore.

5. The method of claim 1, wherein the cable comprises a fiber-optic cable that is configured to obtain the first downhole measurement at a plurality of locations along the fiber-optic cable.

6. The method of claim 1, further comprising cooling the treatment fluid by adding solid carbon dioxide, liquid carbon dioxide, liquid nitrogen, or water ice to the treatment fluid prior to pumping the treatment fluid into the first wellbore.

7. The method of claim 1, further comprising heating the treatment fluid using a boiler or by adding a chemical that generates an exothermic reaction in the treatment fluid prior to pumping the treatment fluid into the first wellbore.

8. The method of claim 1, further comprising reducing a temperature of the treatment fluid by adding solid carbon dioxide into the treatment fluid, wherein the solid carbon dioxide generates gas that causes a cavitation noise in the first wellbore, and wherein the first downhole measurement comprises a pressure or vibration measurement in response to the cavitation noise.

9. The method of claim 1, wherein the one or more additional measurements comprise a first surface measurement obtained by a second sensor at the surface, and wherein the first surface measurement comprises pressure, flow rate, or a combination thereof.

10. The method of claim 9, wherein the one or more additional measurements also comprise a second surface measurement obtained by a third sensor at the surface, and wherein the second surface measurement comprises a pressure wave, a shear wave, or a combination thereof.

11. The method of claim 1, wherein the one or more additional measurements comprise a second downhole measurement obtained by a downhole tool in a second wellbore, and wherein the second downhole measurement comprises a pressure wave, a shear wave, or both.

12. The method of claim 1, further comprising varying a parameter of the treatment fluid being pumped into the first wellbore in response to determining the location where the treatment fluid is flowing, wherein the parameter comprises a pressure, a flow rate, a composition, or a combination thereof.

13. A method, comprising:

running a first downhole tool into a first wellbore;

perforating the first wellbore using the first downhole tool;

running a fiber-optic cable into the first wellbore after the first wellbore is perforated;

varying a temperature of a treatment fluid;

pumping the treatment fluid into the first wellbore as part of a fluid diversion process or a fluid treatment process after the first wellbore is perforated and after the temperature of the treatment fluid is varied;

obtaining a first downhole measurement in the first wellbore using the fiber-optic cable concurrently with or after the fluid diversion process or the fluid treatment process, wherein the first downhole measurement comprises a temperature measurement at a plurality of locations along the fiber-optic cable;

obtaining an additional measurement concurrently with obtaining the first downhole measurement, wherein the additional measurement comprises:

a pressure measurement or a flow rate measurement obtained at a surface location; or a pressure wave measurement or a shear wave measurement obtained in a second wellbore;

combining or comparing the first downhole measurement and the additional measurement;

determining a location where the treatment fluid is flowing through the perforations in the first wellbore based upon the combining or comparing the first downhole measurement and the additional measurement; and varying a parameter of the treatment fluid being pumped into the first wellbore in response to determining the location where the treatment fluid is flowing, wherein the parameter comprises a pressure, a flow rate, a composition, or a combination thereof.

14. A system, comprising:

a first downhole tool configured to be run into a first wellbore and to perforate the first wellbore;

a cable configured to be run into the first wellbore and to obtain a first downhole measurement concurrently with or after a fluid diversion process or a fluid treatment process in the first wellbore, wherein the fluid diversion process or the fluid treatment process takes place after the first wellbore is perforated, and wherein the fluid diversion process or the fluid treatment process comprises pumping a treatment fluid into the first wellbore after a temperature of the treatment fluid is varied;

a first sensor configured to obtain an additional measurement concurrently with the cable obtaining the first downhole measurement; and a processor configured to combine or compare the first downhole measurement and the additional measurement and to determine a location where the treatment fluid is flowing through perforations based upon the combining or comparing the first downhole measurement and the additional measurement.

15. The system of claim 14, wherein the cable comprises a fiber-optic cable that is configured to obtain the first downhole measurement at a plurality of locations along the fiber-optic cable.

16. The system of claim 14, wherein the first sensor is positioned at a surface location, and wherein the additional measurement comprises pressure, flow rate, or a combination thereof.

17. The system of claim 14, wherein the first sensor is positioned in a second wellbore, and wherein the additional measurement comprises a pressure wave, a shear wave, or both.

18. A method, comprising:

pumping a treatment fluid into a first wellbore as part of a fluid diversion process or a fluid treatment process obtaining a first downhole measurement in the first wellbore using a cable in the first wellbore or a first sensor coupled to the cable concurrently with or after the fluid diversion process or the fluid treatment process;

obtaining one or more additional measurements concurrently with obtaining the first downhole measurement, wherein the one or more additional measurements comprise a first surface measurement obtained by a second sensor at the surface, and wherein the first surface measurement comprises pressure, flow rate, or a combination thereof;

combining or comparing the first downhole measurement and the one or more additional measurements; and determining a location where the treatment fluid is flowing through perforations in the first wellbore based upon the combining or comparing the first downhole measurement and the one or more additional measurements.

19. A method, comprising:

pumping a treatment fluid into a first wellbore as part of a fluid diversion process or a fluid treatment process obtaining a first downhole measurement in the first wellbore using a cable in the first wellbore or a first sensor coupled to the cable concurrently with or after the fluid diversion process or the fluid treatment process;

obtaining one or more additional measurements concurrently with obtaining the first downhole measurement, wherein the one or more additional measurements comprise a second downhole measurement obtained by a downhole tool in a second wellbore, and wherein the second downhole measurement comprises a pressure wave, a shear wave, or both;

combining or comparing the first downhole measurement and the one or more additional measurements; and determining a location where the treatment fluid is flowing through perforations in the first wellbore based upon the combining or comparing the first downhole measurement and the one or more additional measurements.

20. The method of claim 19, wherein the one or more additional measurements also comprise a second surface measurement obtained by a third sensor at the surface, and wherein the second surface measurement comprises a pressure wave, a shear wave, or a combination thereof.

* * * * *